US007225799B2

(12) United States Patent
Wang et al.

(10) Patent No.: US 7,225,799 B2
(45) Date of Patent: Jun. 5, 2007

(54) DEVICE COMBINING TWO-WAY VALVE AND CARBON CANISTER AND FUEL TANK WITH THE SAME

(75) Inventors: Aaron Wang, Taoyuan (TW); Chun-Chao Huang, Taoyuan (TW)

(73) Assignee: Sentec E&E Co., Ltd., Taoyuan (TW)

( * ) Notice: Subject to any disclaimer, the term of this patent is extended or adjusted under 35 U.S.C. 154(b) by 77 days.

(21) Appl. No.: 11/178,346

(22) Filed: Jul. 12, 2005

(65) Prior Publication Data

US 2007/0012299 A1 Jan. 18, 2007

(51) Int. Cl.
*F02M 33/02* (2006.01)

(52) U.S. Cl. ..... 123/518; 123/520

(58) Field of Classification Search ..... 123/516, 123/518, 519, 520
See application file for complete search history.

(56) References Cited

U.S. PATENT DOCUMENTS 4,852,761 A * 8/1989 Turner et al. ..... 220/746
5,704,337 A * 1/1998 Stratz et al. ..... 123/519
6,182,693 B1 * 2/2001 Stack et al. ..... 137/565.17
6,269,802 B1 * 8/2001 Denis et al. ..... 123/519
6,273,070 B1 * 8/2001 Arnal et al. ..... 123/519
6,463,915 B2 * 10/2002 Ozaki et al. ..... 123/519
6,467,464 B2 * 10/2002 Burke et al. ..... 123/520
6,698,475 B2 * 3/2004 Schaefer et al. ..... 141/325
7,047,948 B2 * 5/2006 Gerhardt et al. ..... 123/516
7,086,389 B2 * 8/2006 Yamada ..... 123/516
7,100,580 B2 * 9/2006 Lin et al. ..... 123/516
7,134,426 B2 * 11/2006 Uchino et al. ..... 123/518
2005/0284450 A1 * 12/2005 Mills ..... 123/519
2006/0207576 A1 * 9/2006 Mills et al. ..... 123/519

* cited by examiner

*Primary Examiner*—Thomas Moulis

(57) ABSTRACT

A device combining a two-way valve and a carbon canister includes a hollow can, which can be further combined with a fuel tank. The device has a first chamber for regulating inner pressure of the fuel tank and a second chamber containing active carbon. The first chamber is installed with a gas tube which is connected to the fuel tank and a gas channel connected to the second chamber. The second chamber is installed with a gas return tube so as to form the device combining the two-way valve and the carbon canister. The hollow can is assembled to a lateral wall of the fuel tank and the gas tube can be embedded into the fuel tank to form an integral structure.

20 Claims, 8 Drawing Sheets

DEVICE COMBINING TWO-WAY VALVE AND CARBON CANISTER AND FUEL TANK WITH THE SAME

BACKGROUND OF THE INVENTION

The present invention relates to a combination structure, and in particular to a device combining a two-way valve and an active carbon canister and a fuel tank with this device.

In convention, to resolve the problem of evaporation of fuel gas in the fuel tank of a car, generally, a fuel gas reverting tube is added to the fuel tank. Via the negative pressure in the fuel gas inlet end of the engine, the fuel gas is attracted to return to the gas inlet end of an internal combustion engine, so as to be used by the engine. Thereby the fuel gas cannot vent to outside to pollute the environment In above-mentioned gas reverting tube, a carbon canister (C/N) is arranged for absorbing evaporated fuel gas. To regulate an expansion pressure of the fuel gas or a vacuum pressure in the tank, a two-way valve is added to the gas reverting tube for the pressure within the fuel tank to maintain the same state as the atmospheric pressure. Besides to prevent an over large expansion pressure of the fuel gas in the fuel tank to induce explosion or deformation of the fuel tank, a bypass valve is serially connected to the gas reverting tube adjacent to the fuel tank. When the fuel tank, two-way valve or the gas reverting tube is blocked, the bypass valve can be opened for releasing the pressure of fuel gas to protect the fuel tank.

Conventionally, the gas reverting tube connected the fuel tank and the gas inlet of the engine is formed by using soft tubes to be connected between the two-way valve and the carbon canister or connected between the two-way valve, the carbon canister and the bypass valve. However, when the longer the soft tubes or the more the soft tubes are, the resistance in the gas reverting tube is greater, so as to reduce the absorption force of negative pressure of the gas reverting tubes. Thereby fuel gas cannot be reused smoothly. Furthermore, the two-way valve, carbon canister and bypass valve have complicated structures so that the manufacturing and assembled processes are time consuming and cost ineffective. Also the soft tubes are easily arranged disordered to occupy a larger space.

BRIEF SUMMARY OF THE INVENTION

Accordingly, the present invention is to provide a device combining a two-way valve and a carbon canister. The device can assemble to the fuel tank so as to reduce the use of soft tube and beneficial to reduce of the resistance of the fuel gas. The structure of the present invention is simple and can be assembled easily so as to reduce the manufacturing and assembled cost.

The present invention provides a device combining a two-way valve and a carbon canister. A hollow can be installed between a fuel tank and a fuel gas inlet of an engine for returning evaporated fuel gas in the fuel tank to the air inlet of the engine. A first chamber and a second chamber are formed in the hollow can. The two-way valve is formed in the first chamber, which can regulate the expansion pressure or the vacuum pressure in the fuel tank, so as to prevent explosion or deformation of the fuel tank. The carbon canister is formed in the second chamber, which can absorb and store fuel gas temporarily.

In the present invention, a vertical gas tube and a gas channel are arranged in the first chamber. The vertical gas tube is connected to an evaporation chamber of the fuel tank so as to guide the fuel gas volatilize into the first chamber. And the gas channel is communicated to the second chamber so as to guide the fuel gas into the second chamber for absorbing fuel gas (or storing fuel gas temporarily).

In the present invention, a gas return tube is arranged in the second chamber for guiding the fuel gas into the fuel gas inlet end of the engine to be used by the engine. A fuel gas flow tube is arranged in the second chamber for connecting the outside air so as to regulate the inner pressure of the fuel tank or fuel gas reverting tube.

In the present invention, the fuel tank has a casing and an assembled hole is formed on the casing so that the casing is communicated to an evaporation chamber above a surface of fuel liquid. The gas tube is embedded into the assembled hole to guide fuel gas in the fuel tank to flow into the first chamber.

Furthermore, the present invention has a bypass valve. The bypass valve is arranged in the second chamber and to be connected to outside. When the expansion pressure in the fuel tank is resisted and unable to regulate so that the fuel expansion pressure in the fuel tank is too large, the bypass valve can be opened for releasing the pressure of fuel gas to protect the fuel tank.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
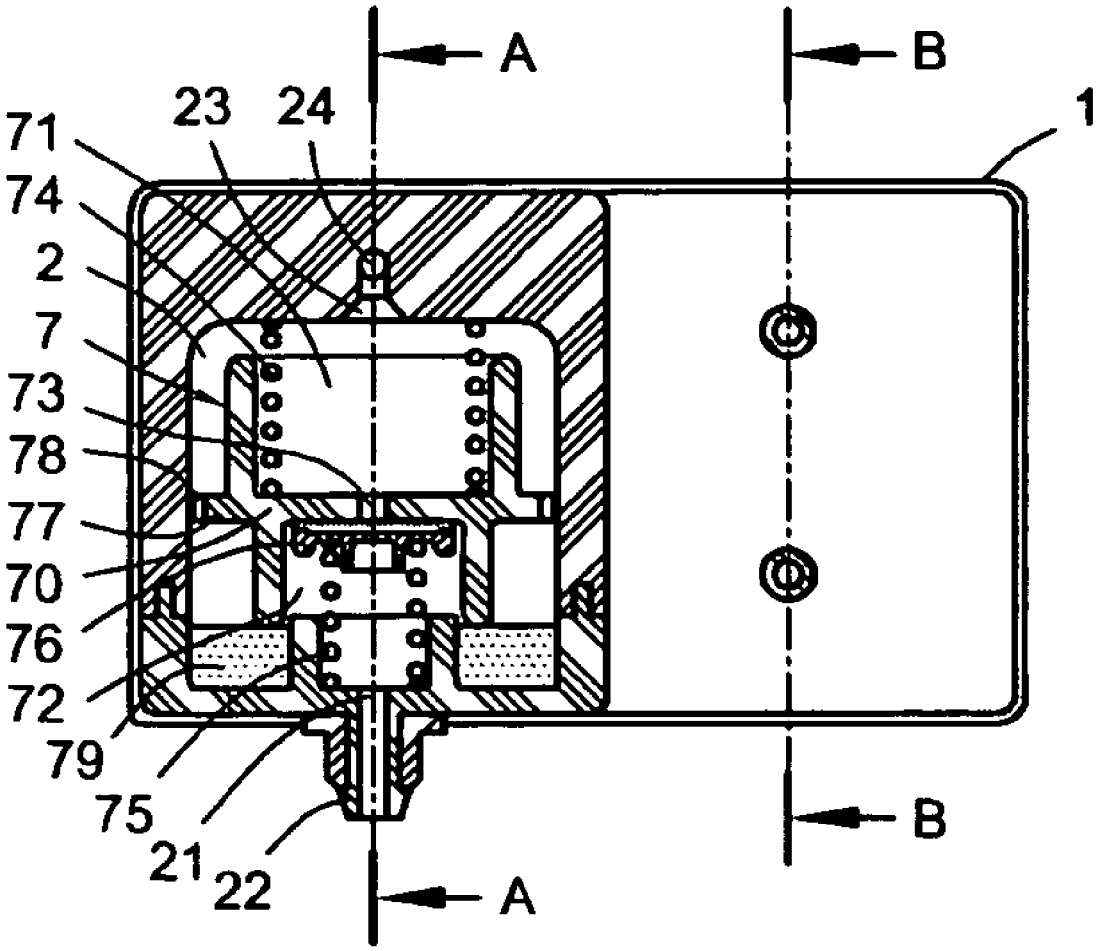
FIG. 1 is an elevational cross sectional view about the first embodiment of the present invention, wherein the hollow can is formed with a first chamber and a second chamber, and the first chamber is installed with a movable element, a top spring and a bottom spring.
Figure 2:
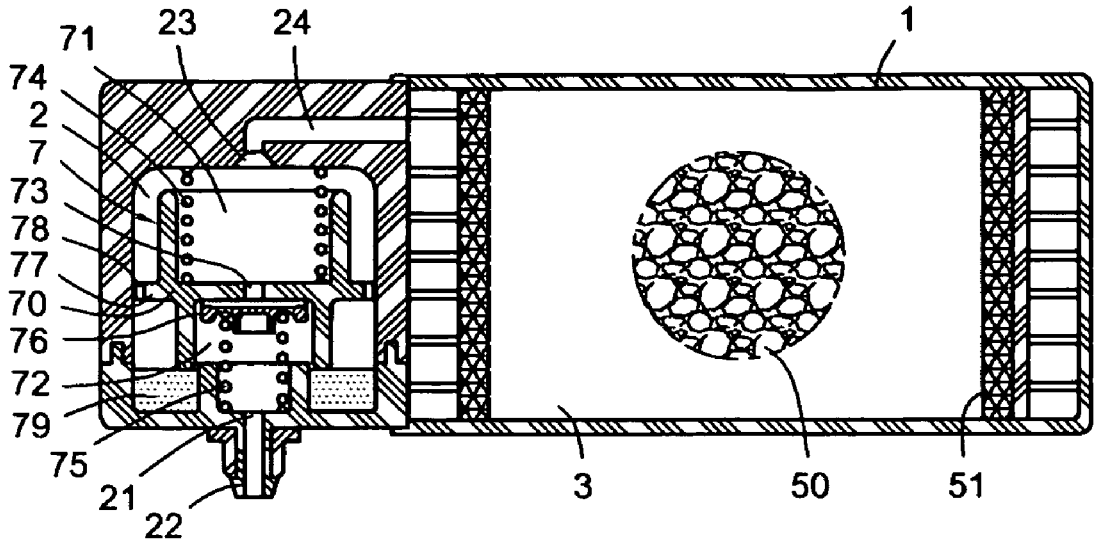
FIG. 2 is a cross sectional view along line A-A of the FIG. 1, and a bottom of the first chamber has a gas tube and a gas channel connected to the second chamber.
Figure 3:
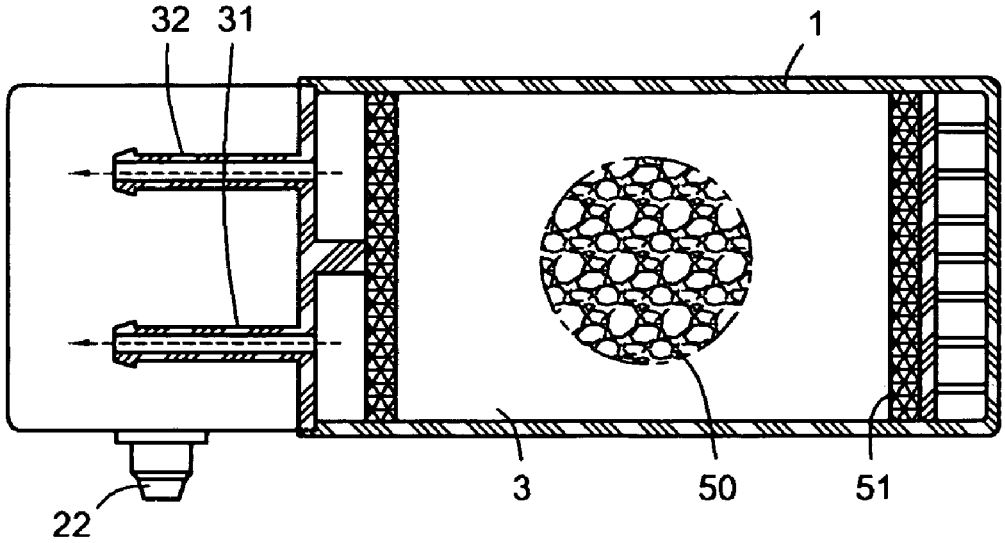
FIG. 3 is a cross sectional view along line B-B of FIG. 2, wherein the second chamber is a carbon canister and has a fuel gas flow tube and a gas return tube.

Referring to FIGS. 1 to 3, the arrangement of the first embodiment of the present invention is illustrated. A transversal hollow can 1 is installed with a first chamber 2 and a second chamber 3 which are spaced at two sides of the hollow can 1.

A top hole 23 and a bottom hole 21 are formed in an interior of the first chamber 2 (referring to FIGS. 1 and 2). An interior of the bottom hole 21 is installed with a protruded gas tube 22 which is communicated to an evaporation chamber 42 in the fuel tank 4 (referring to FIG. 4). A gas channel 24 is formed in the top hole 23 and connected to the second chamber 3. A movable element 7 is installed within the first chamber 2, and a soft washer 79 is installed around the bottom hole 21 of the first chamber 2. At least one valve hole 73 and one trench part 78 are formed in the movable element 7 to regulate the expansion pressure or the vacuum pressure in the fuel tank 4. A top spring 74 is installed between the movable element 7 and a top wall of the first chamber 2 so as to push the movable element 7 downward. A bottom spring 75 is installed between the movable element 7 and a bottom wall of the first chamber 2 so as to push the movable element 7 upward. A dish-shaped valve element 76 is installed between the valve hole 73 and bottom spring 75 so as to open or close the valve hole 73. The valve element 76 can is manufactured as a shape of the spring seat, and installed a soft stopper on the top of the spring seat, so the valve element 76 can close the valve hole 73 effectively when necessary.

Furthermore, the valve hole 73 is formed in a valve wall 70. The valve wall 70 is formed in the movable element 7. The trench part 78 is formed in an annular flange 77. The annular flange 77 is formed in an outside wall of the movable element 7. The top spring 74 is installed in a top trough 71 which is formed in the movable element 7. The bottom spring 75 is installed in a bottom trough 72 which is formed in the movable element 7. Moreover, an effort of the top spring 74 is larger than the bottom spring 75. Thus two-way valve in the transversal hollow can 1 according to the present invention is constructed.

Besides an interior of the second chamber 3 is installed with a plurality of non-weave clothes 51 and active carbons 50 (referring to FIGS. 2 and 3). The non-weave clothes 51 serve to isolate the active carbon 50 from draining out. The non-weave clothes 51 and active carbons 50 serve to as filtering element for filtering impurities in the fuel. Furthermore, at least one gas return tube 32 (referring to FIGS. 1 and 3) is connected between the second chamber 3 and a fuel gas inlet end of an internal combustion engine, so as to supply return fuel gas. Furthermore, the second chamber 3 may be further installed with an extra fuel gas flow tube 31 which is connected to outside for regulating the internal pressure (expansion pressure or vacuum pressure) in the fuel tank 4.

Furthermore, the second chamber 3 is formed with a carbon canister for absorbing fuel gas (or storing fuel gas temporarily). Thereby the second chamber 3 is integrally formed with the two-way valve in the hollow can 1.

The gas tube 22 in the hollow can 1 can be connected to the fuel tank 4 through a soft tube for receiving returning fuel gas. Or in the following second embodiment, the transversal hollow can 1 and the fuel tank 4 are integrally formed without using any soft tube.

In the second embodiment of the present invention (referring to FIG. 4), the transversal hollow can 1 is integrally formed with the fuel tank 4. A fuel filling opening 44 is formed on the fuel tank 4 so that fuel liquid 41 can be filled into the fuel tank 4. A surface of the fuel liquid 41 in the fuel tank 4 is installed with an evaporation chamber 42. A top of a casing of the fuel tank 4 is formed with an assembled hole 43 which is communicated to the evaporation chamber 42. The gas tube 22 can be received in the assembled hole 43 so that the fuel gas in the fuel tank 4 can be guided into the first chamber 2 with lower resistance and the hollow can 1 can be assembled at the top of the evaporation chamber 42 of the fuel tank 4. Thereby the assembled body according to the present invention is formed.

According to above mentioned structure, when the engine does not start, the negative pressure is not supplied into the first chamber 2 and the second chamber 3. The movable element 7 is pushed downward by the top spring 74 to compress the valve element 76 closing the valve hole 73 tightly (referring to FIG. 4), and a bottom end of the bottom trough 72 of the movable element 7 can compress the soft washer 79, and then separating the channel of fuel gas between the bottom trough 72 and the first chamber 2, so that no fuel gas in the fuel tank 4 will drain out.

Figure 5:
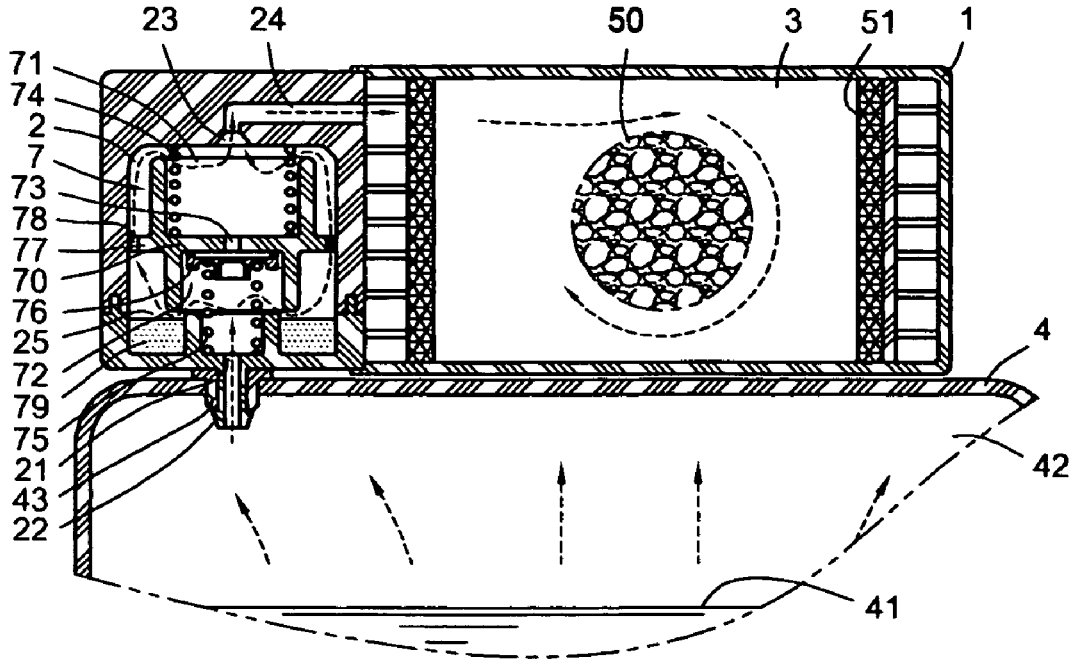
FIG. 5 is a schematic view about the operation of the present invention, wherein when the expansion pressure is formed in the fuel tank can push the movable element upward so as to guide fuel gas flow through the first chamber and second chamber so that to be supplied to the engine to regulate the expansion pressure in the fuel tank.

According to above mentioned state, while producing the expansion pressure because the external temperature rises to make the fuel gas volatilize to evaporate to concentrate in the evaporation chamber 42, the expansion pressure can push the movable element 7 upward and press the top spring 74 so as to open a gas gate 25 (referring to FIG. 5) between the bottom trough 72 and the first chamber 2. thus the evaporated fuel gas in the fuel tank 4 will flow through the gas tube 22, bottom hole 21, gas gate 25, trench part 78 and gas channel 24 to be transferred to the second chamber 3 to be absorbed (or stored temporarily), and then return to be supplied to the engine, so as to regulate the expansion pressure in the fuel tank 4.

Figure 6:
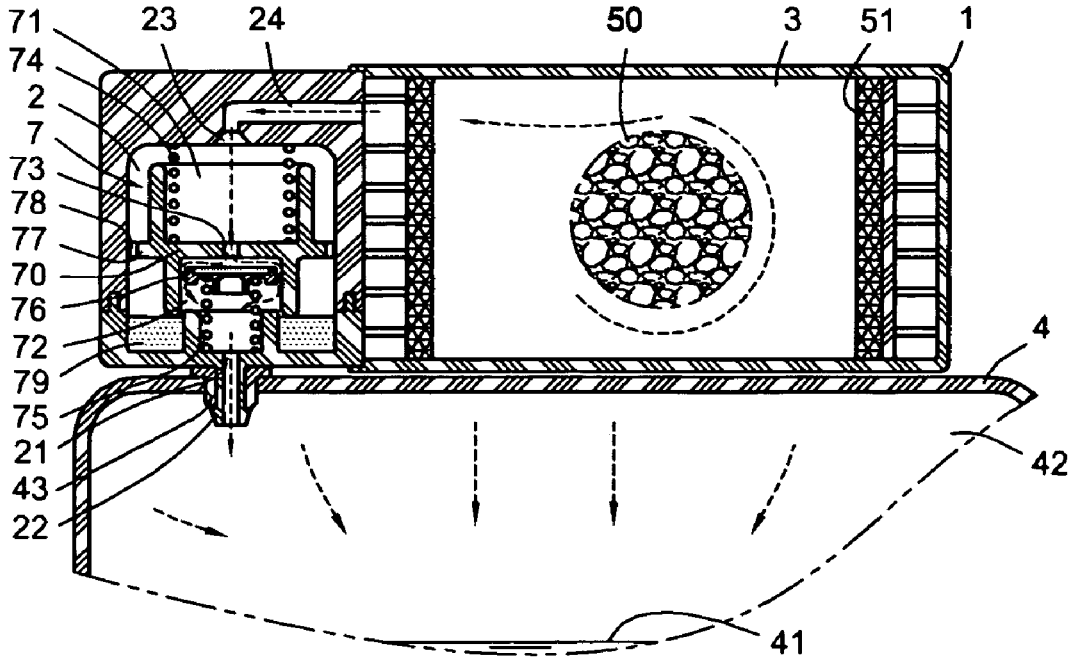
FIG. 6 is another schematic view about the operation of the present invention, wherein when the vacuum pressure is formed in the fuel tank can draw the valve element downward so as to open the valve hole and then guiding the outside air into the fuel tank to regulate the vacuum pressure.

According to above mentioned state, while producing the vacuum pressure in the fuel tank 4 because the external temperature drops and the vacuum pressure, as the vacuum pressure in the fuel tank 4 is larger than the effort of the bottom spring 75, the vacuum pressure can draw the valve element 76 downward and press the bottom spring 75 so as to open the valve hole 73 (referring to FIG. 6). Thus the outside air will flow through the fuel gas flow tube 31, second chamber 3 and then into first chamber 2, and then via the valve hole 73, bottom trough 72, bottom hole 21 and gas tube 22 to be transferred to the fuel tank 4, so as to regulate the vacuum pressure in the fuel tank 4.

Figure 4:
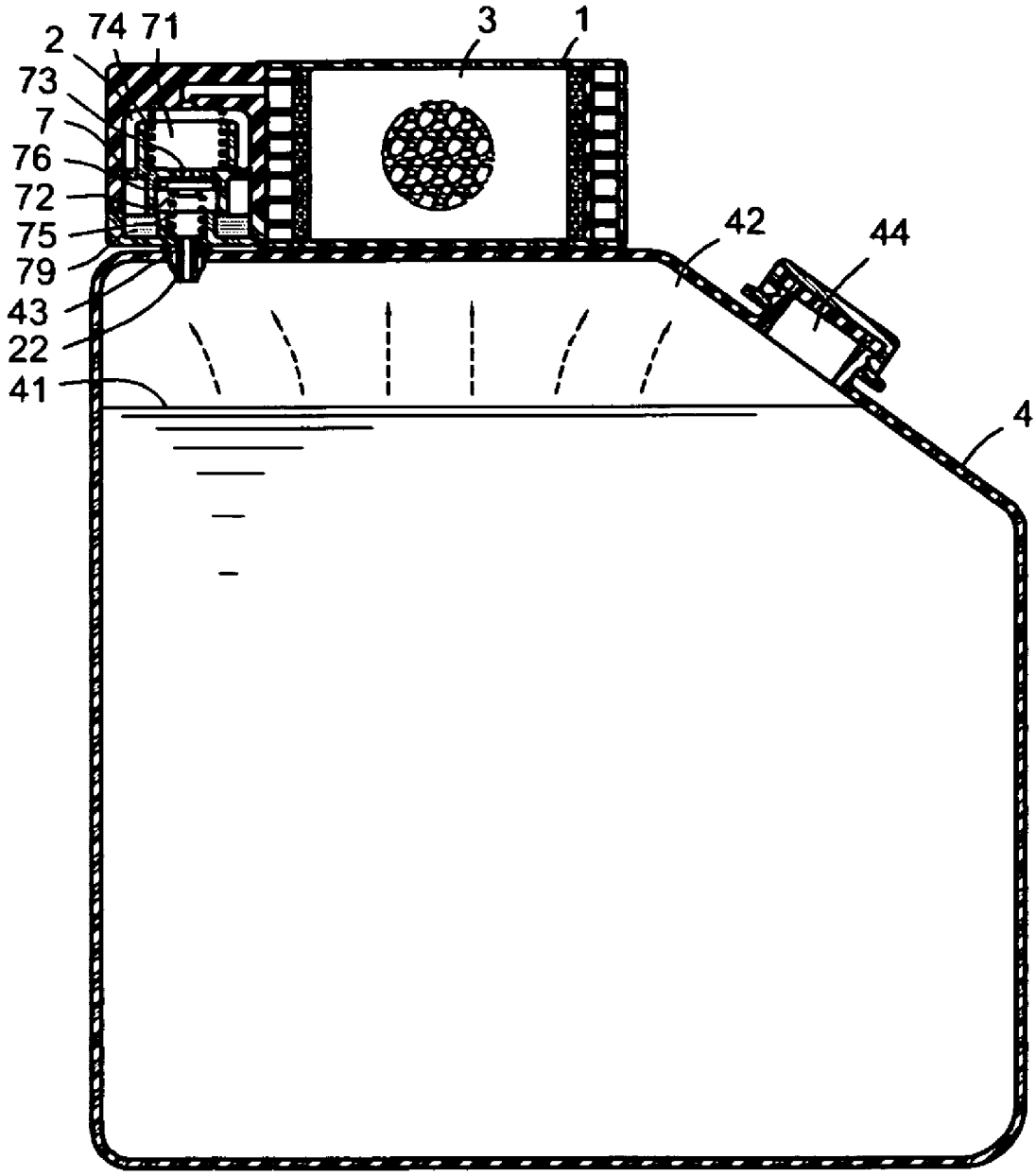
FIG. 4 is a cross sectional view about the second embodiment of the present invention, wherein a transversal hollow can is assembled to a top of the evaporation chamber of the fuel tank, so that the gas tube is embedded into an assembled hole so as to form an assembled body of the hollow can and the fuel tank.

When starting the engine, fuel is supplied in a normal condition (referring to FIG. 4). The fuel gas inlet end of the engine has a negative pressure which will absorb the fuel gas in the second chamber 3 of the hollow can 1, wherein the negative pressure will through the gas return tube 32 (referring to FIG. 3) into the first chamber 2 to draw the movable element 7 upward, so that the evaporated fuel gas in the fuel tank 4 will flow (referring to FIG. 6), so as to open the gas gate 25 between the bottom trough 72 and the first chamber 2. Thus evaporated fuel gas in the fuel tank 4 will return into the second chamber 3 with less resistance, and then return to the fuel gas inlet end, and then mix with new formed fuel gas to be supplied to the engine.

Figure 7:
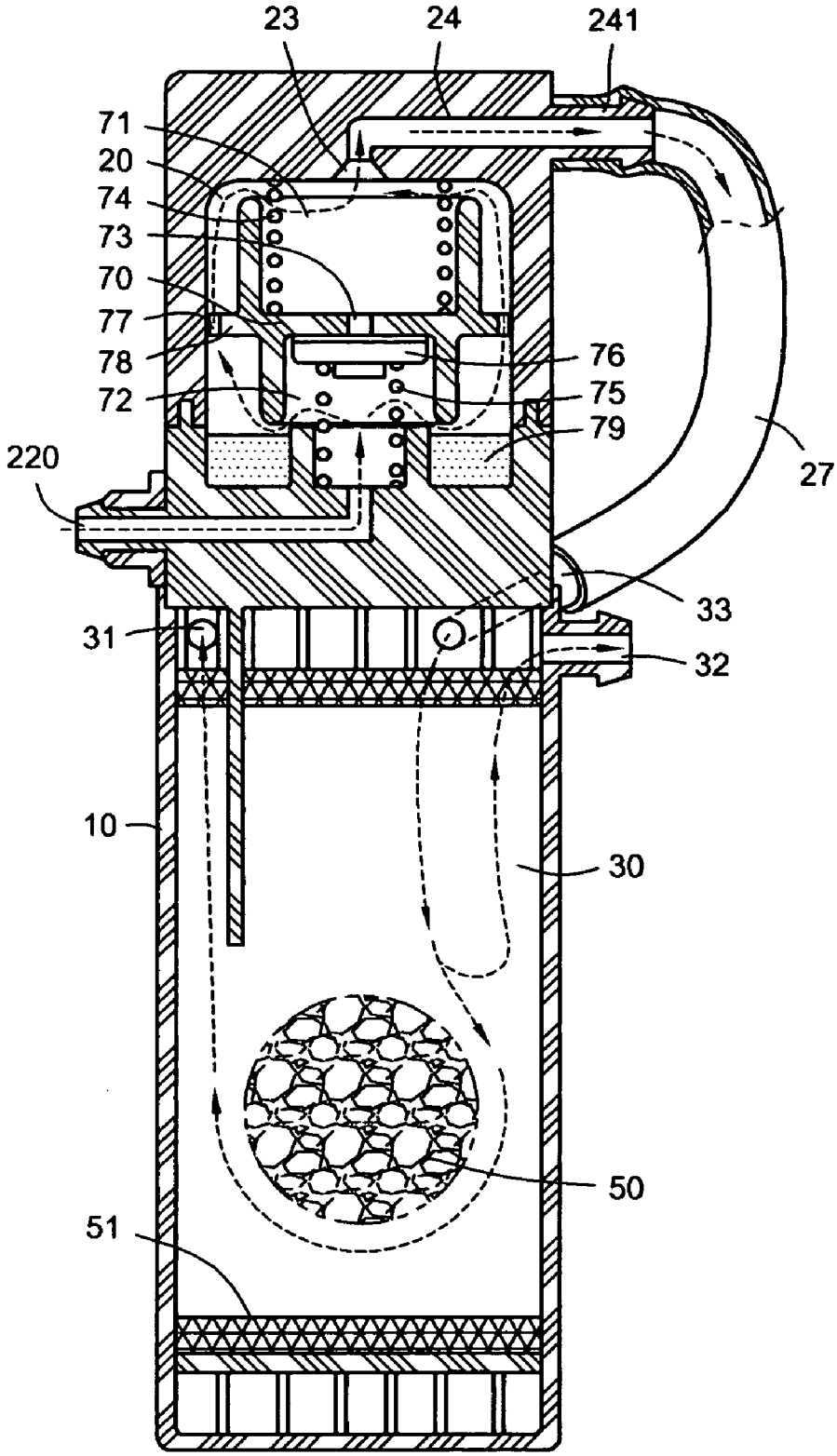
FIG. 7 shows the third embodiment of the present invention, wherein a vertical hollow can is disclosed, it uses a connecting tube to guide fuel gas into the second chamber.

Besides, referring to FIG. 7, the third embodiment of the present invention is illustrated. The difference of this embodiment from the above one is that the hollow can 10 is arranged vertically. The vertical hollow can 10 is formed with a first chamber 20 and a second chamber 30 which are spaced vertically. A gas channel 24 of the first chamber 20 is installed with an external connecting tube 241. The first chamber 20 has a gas tube 220 which extends to a lateral side of the first chamber 20. Furthermore, a guide tube 33 is added to the second chamber 30. A connecting tube 27 serves to connect the external connecting tube 241 to the guide tube 33 so that fuel gas in the first chamber 20 will be guided to the second chamber 30. Other structure of this embodiment is identical to those above the embodiments and thus the details will not be described herein.

Figure 8:
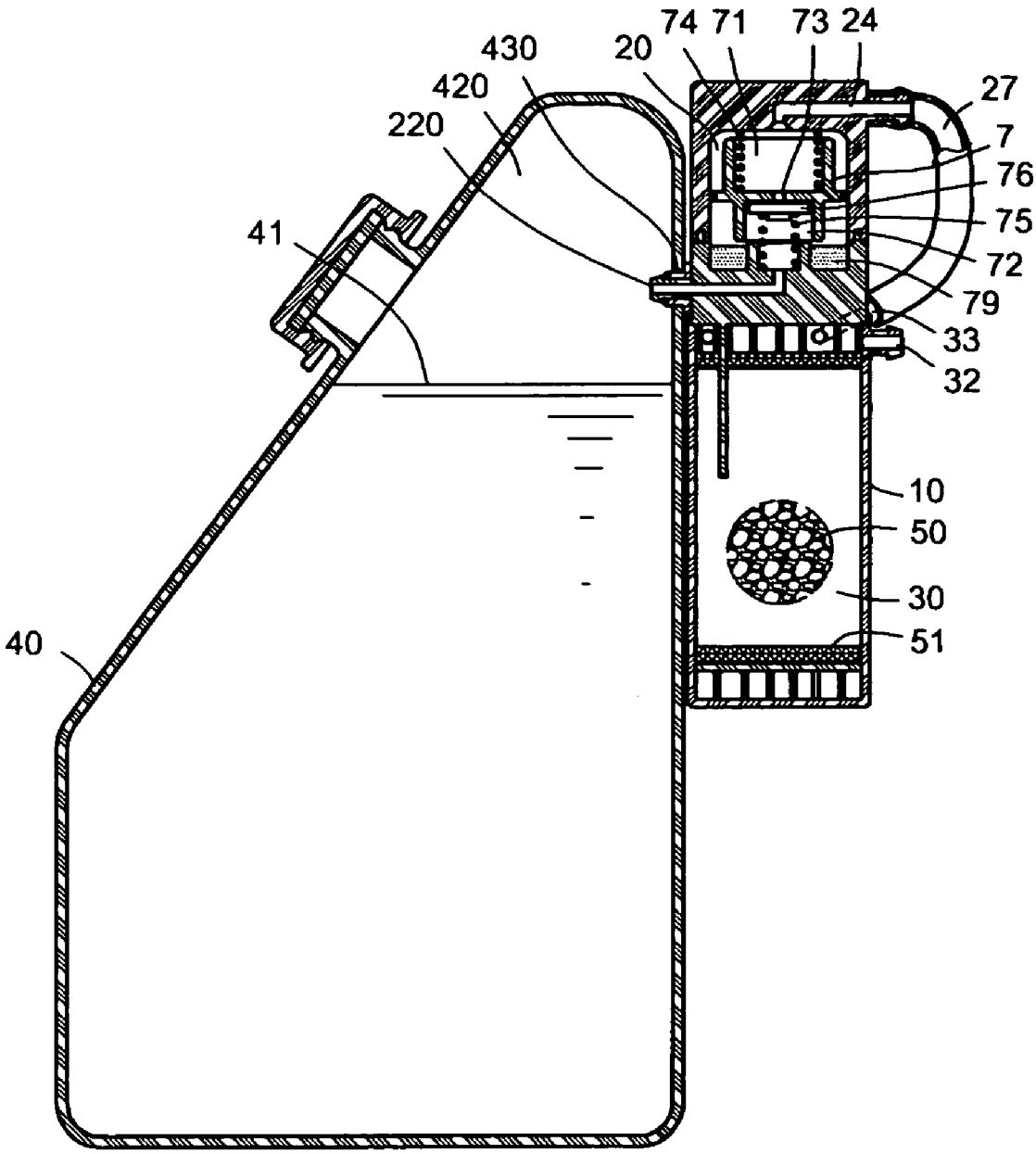
FIG. 8 is a cross sectional view about the fourth embodiment of the present invention, wherein a vertical hollow can is assembled to a lateral side of the fuel tank so that the connecting tube is embedded into the assembled hole to form an assembled body of the hollow can and the fuel tank.

Referring to FIG. 8, a fourth embodiment of the present invention is illustrated. In this embodiment, the vertical arranged hollow can 10 is arranged at a lateral side of the fuel tank 40. The assembled hole 430 is formed at the casing of the fuel tank 40. The assembled hole 430 is communicated to an evaporation chamber 420 so that the lateral arranged gas tube 220 is embedded into the assembled hole 430 at the lateral side of the fuel tank 40. Thereby the vertical hollow can 10 can be easily assembled to the casing at the lateral side of the fuel tank 40. Other structure of this embodiment is identical to those above the embodiments and thus the details will not be described herein.

Figure 9:
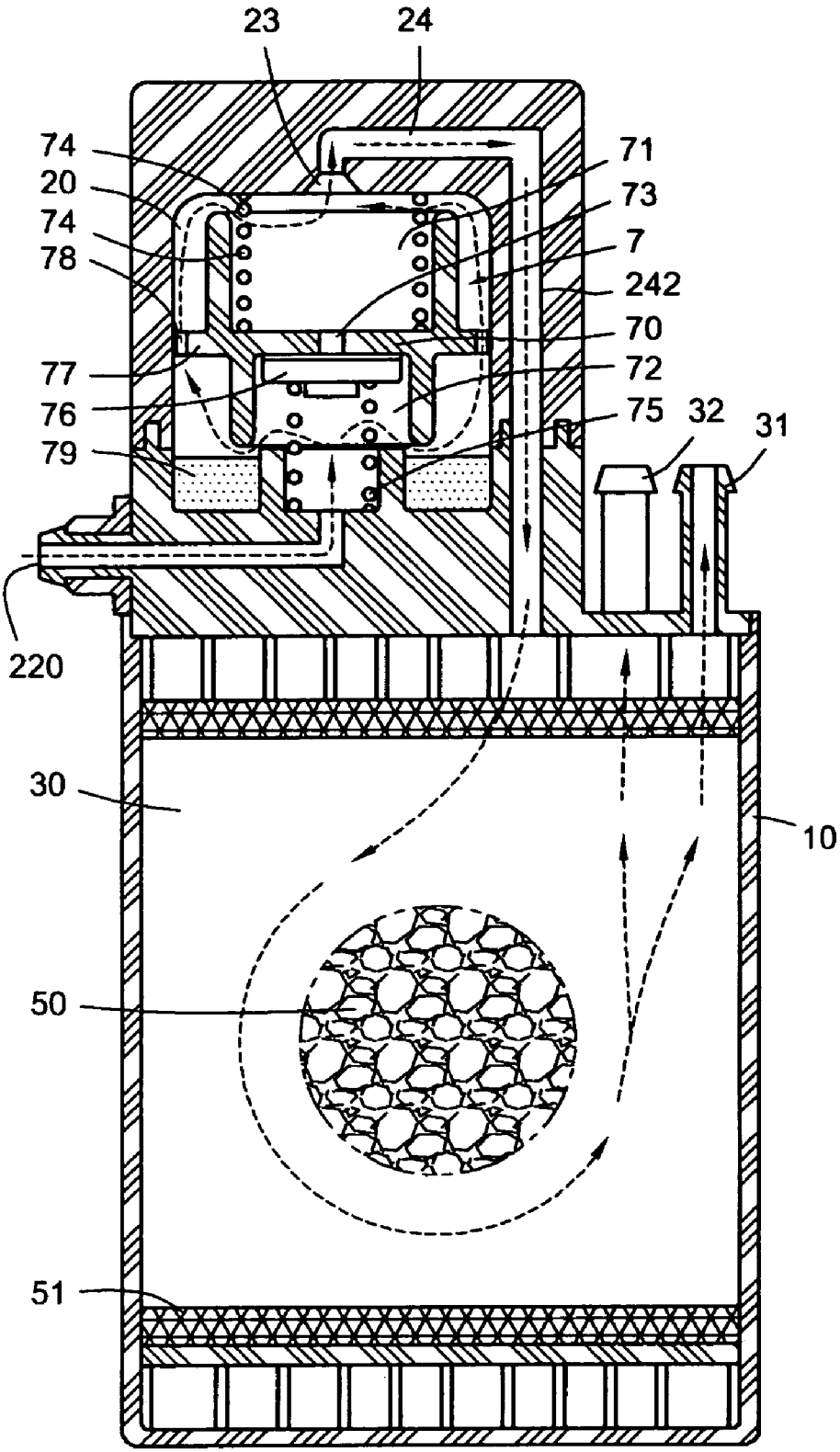
FIG. 9 shows a cross sectional view about the fifth embodiment of the present invention, wherein the gas channel in the vertical hollow can has an extended channel. The extended channel is communicated to the second chamber.

With reference to FIG. 9, a fifth embodiment of the present invention, which is extended from the third and fourth embodiments of the present invention, is illustrated. The difference of this embodiment from above two preferred embodiments will be described herein. The gas channel 24 in the vertical hollow can 10 directly extends to a bottom of the first chamber 20 so as to form an extension channel 242 which is communicated to the second chamber 30. Thereby the fuel gas in the first chamber 20 of the hollow can 10 is guided into the second chamber 30. Other structure of this embodiment is identical to those above the embodiments and thus the details will not be described herein. It can be assembled to a lateral side of the fuel tank 40 in the fourth embodiment.

Figure 10:
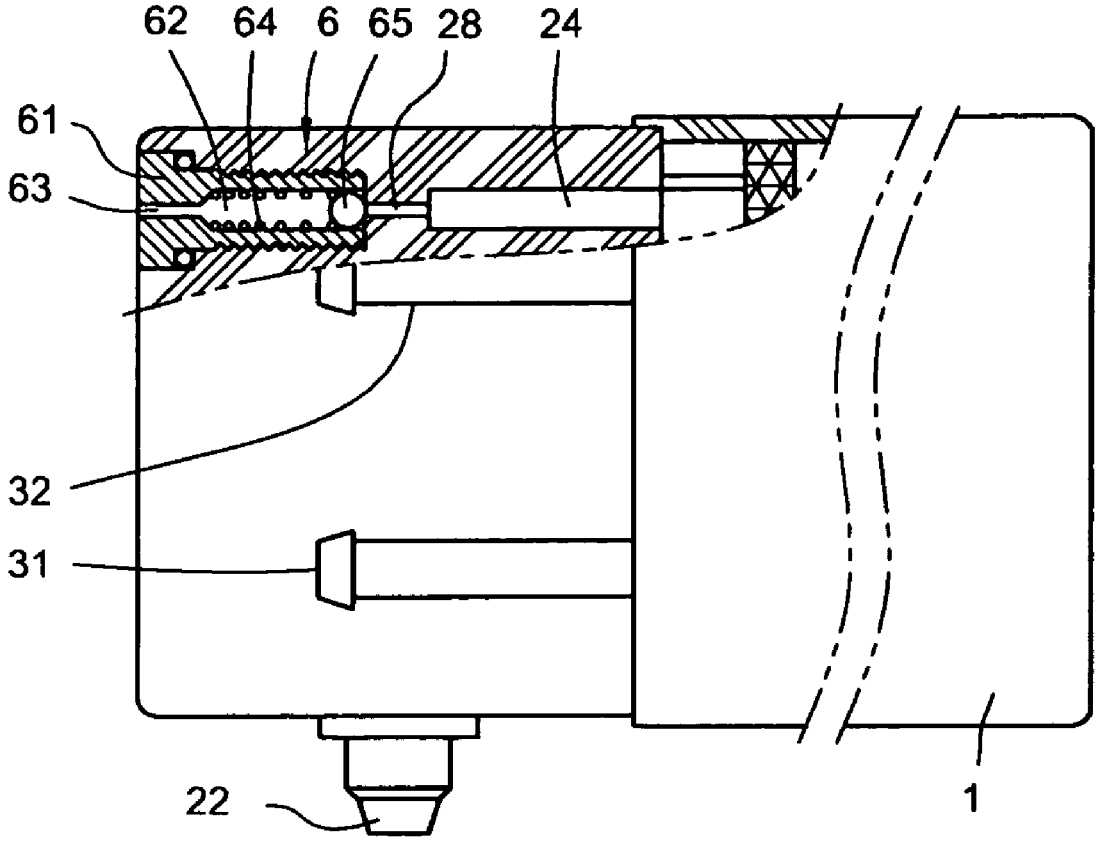
FIG. 10 shows the cross sectional view about the sixth embodiment of the present invention, wherein a bypass valve is installed with the gas channel for reducing the expansion pressure of fuel gas.

The sixth embodiment of the present invention will be described herein. The gas channel 24 in the hollow can 1 or vertical hollow can 10 is formed with a pressure releasing hole 28 and is connected to a bypass valve 6 which is communicated with outside (referring to FIG. 10). The bypass valve 6 includes a lock stud 61 on the hollow can 1 or 10. The lock stud is installed with a venting hole 63 and a spring receiving hole 62 which are communicated to the pressure releasing hole 28. A spring 64 is installed within the spring receiving hole. The spring 62 resists against a round ball 65 for sealing or opening the pressure releasing hole 28. The venting hole 63 is communicated to outside. Thereby when the expansion pressure in the fuel tank 4 or 40 is resisted and unable to regulate so that the fuel expansion pressure in the fuel tank 4 or 40 is to large, for example over 4 Psi, the fuel gas in the fuel channel will push the round ball 65 in the bypass valve 6 to open the pressure releasing hole 28 so that the expansion pressure of the fuel tank 4 or 40 will be released to balance the internal pressure of the fuel tank 4 or 40.

Advantages of the present invention will be described herein. Because of the two-way valve and the carbon canister are assembled within the hollow can, and the hollow can is assembled to the fuel tank, so that the use of the soft tube is reduced so as to reduce the manufacturing and assembled cost. The reduction of soft tube connected between the fuel tank and fuel inlet end of the engine is beneficial to the reduction of the resistance of the fuel gas. The structure of the present invention is simple and can be assembled easily.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A device combining a two-way valve and a carbon canister in a hollow can, being installed between a fuel tank and a fuel gas inlet of an engine for returning evaporated fuel gas in the fuel tank to the engine, the hollow can comprising a first chamber for installing the two-way valve and a second chamber to form the carbon canister;

the two-way valve including:

a top hole and a bottom hole respectively formed in the top wall and the bottom wall of the first chamber, an interior of the bottom wall being installed with a gas tube to connect the bottom hole to an evaporation chamber in the fuel tank;

a gas channel formed in the top wall to connect the top hole to the second chamber;

a movable element installed within the first chamber to be located between the top and the bottom walls;

at least one valve hole and one trench formed in the movable element;

a top spring installed between the movable element and the top wall of the first chamber so as to push the movable element downward;

a bottom spring installed between the movable element and the bottom wall of the first chamber so as to push the movable element upward; and a dish-shaped valve element installed between the valve hole and the bottom spring so as to close the valve hole; and the carbon canister including:

a plurality of non-woven clothes and active carbons installed within the second chamber; and at least one gas return tube connected between the second chamber and the fuel gas inlet, thereby when the engine does not start but in expansion pressure is formed in the evaporation chamber or the engine is operated to form a negative pressure, the movable element is lifted upward by the evaporated fuel gas accumulated in the evaporation chamber to open a gas gate so that the evaporated fuel gas in the fuel tank flows through the gas tube, bottom hole, gas gate, trench and gas channel to the second chamber and then flows from the hollow chamber through the gas return tube and the fuel gas inlet to the engine.

2. The device as claimed in claim 1, wherein the valve hole is formed in a valve wall of the movable element.

3. The device as claimed in claim 1, wherein the trench is formed in an annular flange of an outside wall of the movable element.

4. The device as claimed in claim 1, wherein the top spring is installed in a top trough of the movable element and the bottom spring is installed in a bottom trough of the movable element.

5. The device as claimed in claim 1, wherein a soft washer is installed around the bottom hole of the first chamber.

6. The device as claimed in claim 1, wherein the gas channel in the hollow can is installed with an external connecting tube, the second chamber is installed with a guide tube, and a connecting tube is connected between the external connecting tube and the guide tube.

7. The device as claimed in claim 1, wherein the gas channel in the hollow can directly extends to a bottom of the first chamber to form as an extension channel which is communicated to the second chamber.

8. The device as claimed in claim 1, wherein the second chamber is installed with a fuel gas flow tube which is connected to outside so that when the engine does not start but a vacuum pressure formed in the fuel tank is enough to draw the valve element downward by pressing the bottom spring to open the valve hole, outside air flows through the fuel gas flow tube to the second chamber and through the gas channel to the first chamber, and then via the valve hole, bottom hole and gas tube to the fuel tank.

9. The device as claimed in claim 1, wherein the gas channel has a pressure releasing hole and is connected to a bypass valve so as to be connected to outside.

10. The device as claimed in claim 9, wherein the bypass valve includes a lock stud on the first chamber of the hollow can; the lock stud is installed with a venting hole and a spring receiving hole which are communicated to the pressure releasing hole, a spring is installed within the spring receiving hole, and the spring pushes against a round ball for sealing or opening the pressure releasing hole.

11. A fuel tank for an engine, comprising:

hollow can which includes a first chamber for installing a two-way valve and a second chamber to form a carbon canister the two-way valve including:

a top hole and a bottom hole respectively formed in the top wall and the bottom wall of the first chamber, an interior of the bottom wall being installed with a gas tube to connect the bottom hole to an evaporation chamber in the fuel tank;

a gas channel formed in the top wall to connect the top hole to the second chamber;

a movable element installed within the first chamber to be located between the top and the bottom walls;

a top trough and a bottom trough formed in the movable element, wherein a wall is formed between the top trough and bottom trough, at least one valve hole is formed in the wall, an annular flange is extended from the wall of the movable element, and at least one trench is formed in the annular flange;

a top spring installed between the top trough and the top wall of the first chamber so as to push the movable element downward;

a bottom spring installed between the bottom trough and the bottom wall of the first chamber so as to push the movable element upward; and a dish-shaped valve element installed between the valve hole and the bottom spring so as to close the valve hole; and the carbon canister including:

a plurality of non-woven clothes and active carbons installed within the second chamber; and at least one gas return tube connected between the second chamber and the fuel gas inlet; and a fuel tank casing filled with fuel liquid to form an evaporation chamber above a surface of the fuel liquid at top portion of the casing, an assembled hole being formed on top of the casing so that the gas tube is connected with the assembled hole to assemble the hollow can on the casing;

thereby when the engine does not start but an expansion pressure is formed in the evaporation chamber or the engine is operated to form a negative pressure, the movable element is lifted upward by the evaporated fuel gas accumulated in the evaporation chamber to open a gas gate so that the evaporated fuel gas in the fuel tank flows through the gas tube, bottom hole, gas gate, trench and gas channel to the second chamber, and then flows from the hollow chamber through the gas return tube and the fuel gas inlet to the engine.

12. The device as claimed in claim 11, wherein the valve hole is formed in a valve wall of the movable element.

13. The device as claimed in claim 11, wherein a trench is formed in an annular flange of an outside wall of the movable element.

14. The device as claimed in claim 11, wherein the top spring is installed in the top trough of the movable element, and the bottom spring is installed in the bottom trough of the movable element.

15. The device as claimed in claim 11, wherein a soft washer is installed around the bottom hole of the first chamber.

16. The device as claimed in claim 11, wherein the gas channel in the hollow is installed with an external connecting tube; and the second chamber is installed with a guide tube; and a connecting tube is connected between the external connecting tube and the guide tube.

17. The device as claimed in claim 11, wherein the gas channel in the vertical hollow can directly extends to a bottom of the first chamber to form as an extension channel which is communicated to the second chamber.

18. The device as claimed in claim 11, wherein the second chamber is installed with a fuel gas flow tube which is connected to outside so that when the engine does not start but a vacuum pressure formed in the fuel tank is enough to draw the valve element downward by pressing the bottom spring to open the valve hole, outside air flows through the fuel gas flow tube to the second chamber and through the gas channel to the first chamber, and then via the valve hole bottom hole, and gas tube to the fuel tank.

19. The device as claimed in claim 11, wherein the gas channel has a pressure releasing hole and is connected to a bypass valve so as to be connected to outside.

20. The device as claimed in claim 19, wherein the bypass valve includes a lock stud on the first chamber of the hollow can, the lock stud is installed with an venting hole and a spring receiving hole which are communicated to the pressure releasing hole, a spring is installed within the spring receiving hole, and the spring pushes against a round ball for sealing or opening the pressure releasing hole.

* * * * *